United States Patent [19]
Fortner et al.
[11] 4,402,437
[45] Sep. 6, 1983

[54] PROTECTION ARRANGEMENT FOR A CASTING JET EMERGING FROM A METALLURGICAL VESSEL

[75] Inventors: Walter Fortner, Linz; Erich Misera, Leonding; Franz Landerl, Enns; Günther Robiczek, Traun; Meinhard Berger, Linz, all of Austria

[73] Assignee: Voest-Alpine Aktiengesellschaft, Linz, Austria

[21] Appl. No.: 216,987

[22] Filed: Dec. 16, 1980

[30] Foreign Application Priority Data

Jan. 25, 1980 [AT] Austria ..... 413/80

[51] Int. Cl.[3] ..... B22D 11/10; B22D 41/08

[52] U.S. Cl. ..... 222/607; 164/415; 164/437

[58] Field of Search ..... 164/415, 437, 259; 222/603, 607; 266/207, 217, 236

[56] References Cited

U.S. PATENT DOCUMENTS

| | | | |
|---|---|---|---|
| 3,376,030 | 4/1968 | Adams | 266/236 |
| 3,963,224 | 6/1976 | Pollard | 164/415 X |
| 4,211,390 | 7/1980 | Poole et al. | 164/415 X |
| 4,262,827 | 4/1981 | DeMasi et al. | 222/607 |
| 4,313,596 | 2/1982 | King | 266/207 |

FOREIGN PATENT DOCUMENTS

| | | |
|---|---|---|
| 1536/74 | 12/1975 | Austria . |
| 349666 | 4/1979 | Austria . |
| 2621557 | 4/1977 | Fed. Rep. of Germany . |
| 2946183 | 7/1980 | Fed. Rep. of Germany . |

*Primary Examiner*—Gus T. Hampilos
*Assistant Examiner*—J. Reed Batten, Jr.
*Attorney, Agent, or Firm*—Brumbaugh, Graves, Donohue & Raymond

[57] ABSTRACT

A protection arrangement for a casting jet emerging from a metallurgical vessel includes a protective tube enveloping the casting jet and fastened to an articulation-rod assembly that is pivotable into any space direction. In order to be able to follow any desired position of the casting jet with the protective tube, the articulation-rod assembly includes a first, vertically extending, four-bar linkage parallelogram which is mounted with its vertically arranged web so as to be rotatable about a vertical axis. To its coupler, an extension arm carrying the protective tube is hinged, forming the oscillating crank of a second four-bar linkage. The web of the second four-bar linkage is formed by an oscillating crank of the first four-bar linkage parallelogram.

9 Claims, 10 Drawing Figures

IV
V
4
5
6
7
8
9
10
11
12
13
14
15
16
17
18
19
20
21
22
23
25
26
27
28
32

PROTECTION ARRANGEMENT FOR A CASTING JET EMERGING FROM A METALLURGICAL VESSEL

BACKGROUND OF THE INVENTION

The invention relates to a protection arrangement for a casting jet emerging from a metallurgical vessel, in particular from a casting ladle, comprising a protective tube enveloping the casting jet and fastened to an articulation-rod assembly that is pivotable into any space direction.

It is known from the Austrian application Ser. No. A 1536/74 to let the casting jet flow through a protective tube on the way from a metallurgical vessel into a mould, which protective tube is fastened to a holding means stationarily mounted by means of a spherical joint. This fastening allows for a tilting and rotating of the protective tube and a movement into and out of the intended operating position. It is, however, not possible with this known arrangement to allow the protective tube to assume any desired position at different distances from the holding means and from the spherical joint, so that the protective tube with the known arrangement must be especially adapted to the respective position of the casting jet and the outflow opening of the metallurgical vessel.

SUMMARY OF THE INVENTION

The invention aims at avoiding these disadvantages and difficulties and has as its object to design a protection arrangement of the initially-defined kind in a manner that the protective tube can follow any desired position of the casting jet, i.e., that it can assume any desired position at different distances from the mounting of the anticulation-rod assembly carrying the protective tube.

This object is achieved according to the invention in that the articulation-rod assembly comprises a first four-bar linkage parallelogram extending vertically and mounted to be rotatable with its vertically arranged web about a vertical axis, and to whose coupler an extension arm carrying the protective tube is hinged, forming the oscillating crank of a second four-bar linkage whose web is formed by an oscillating crank of the first four-bar linkage parallelogram.

Advantageously, an oscillating crank of the first four-bar linkage parallelogram is designed to be extended beyond the web of the same, a counter weight being arranged on the extension.

In order to prevent an upward pivoting of the protective tube beyond a certain measure, one oscillating crank of the first four-bar linkage parallelogram advantageously is designed to be extended beyond its web and coacts with a stop arranged on the web of this four-bar linkage parallelogram, which stop preferably is adjustable.

Suitably, the web of the first four-bar linkage parallelogram is rotatably fastened to a tundish of a continuous casting plant, into which the casting jet flows.

For the purpose of an easier handling, one oscillating crank of the second four-bar linkage comprises an extension which is designed as an actuation lever.

According to a preferred embodiment, the protective tube is supportable on a centering shoulder of a slide closing an outflow opening of a ladle and is automatically pressable thereto by means of the counterweight, wherein the protective tube advantageously is mounted on the extension arm to be rotatable about its longitudinal axis. Thereby the protective tube, when leaning against the slide, can follow the slide during the actuation of the slide on maintaining its position relative to the slide without a rotation taking place between the slide and the protective tube.

BRIEF DESCRIPTION OF THE DRAWINGS

The invention will now be explained in more detail by way of several embodiments illustrated in the accompanying drawings, wherein.

DESCRIPTION OF EXEMPLARY EMBODIMENTS

Figure 1:
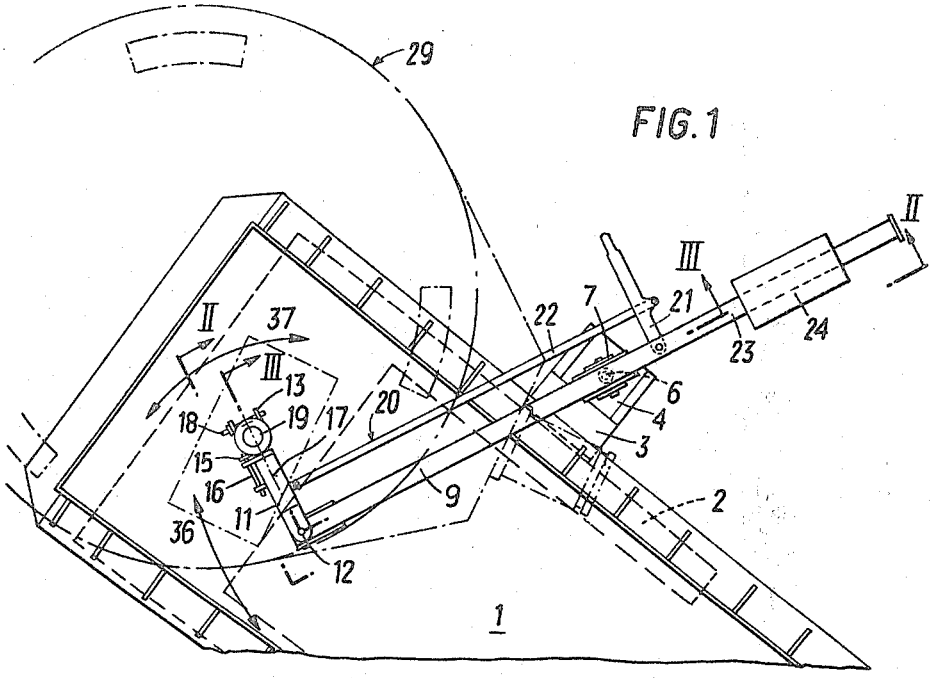
FIG. 1 is a view onto a tundish of a continuous casting plant from above.

A tundish 1 is inserted in a tundish holding-means 2 (illustrated in FIG. 1 by broken lines), at which a lateral console 3 is arranged carrying a column 4 that rises beyond the height of the tundish 1. On this column 4, a vertically directed, first four-bar linkage parallelogram 5 is rotatably mounted, the rotation axis 6 being vertically directed and coinciding with the web 7 of the four-bar linkage parallelogram 5. The coupler 8 of this four-bar linkage parallelogram therefore is also vertically directed. The articulation axes connecting the oscillating cranks 9, 10 in the coupler 8 and the web 7 extend in the horizontal direction. On the coupler 8 of this four-bar linkage parallelogram an extension arm 11 is mounted also to be rotatable about a vertical axis 12. On the extension arm 11, a U-shaped protective-tube holder 13 is detachably inserted. This protective-tube holder 13 can be secured in its axial position by means of a securing pin 14, and can be fixed on the extension arm 11 against rotation about its axis 17 by a socket pin 16 which is axially displaceable on the extension arm 11 and insertable into a lateral bracket 15 of the protective-tube holder 13. A securing pin 18 penetrating both legs of the U-shaped protective-tube holder secures the protective tube 19 against falling out.

The extension arm 11 forms an oscillating crank of a further four-bar linkage 20, which advantageously is also designed as a four-bar linkage parallelogram. The web of this second four-bar linkage parallelogram 20 is formed by an oscillating crank 9 of the first four-bar linkage parallelogram 5. A further oscillating crank 21, which is designed as an actuation lever, is connected via a coupler 22 with the extension arm 11, i.e. with the oscillating crank of the second four-bar linkage parallelogram 20. The oscillating crank 9 of the first four-bar linkage parallelogram 5 is designed to be extended beyond the web 7; the extension 23 serves for accommodating a counter weight 24, which is dimensioned such that the protective tube 19 is automatically pressed upwardly with a certain force. The extension 23 coacts with an adjusting screw 25 mounted on the web 7 and forming a stop by which the upward movement of the protective tube is limited.

The web 7, which extends into the column 4 with a peg 26, is mounted at the column by means of a thrust ball bearing 27. In order to ensure an easier pivotability of the extension arm 11, the latter also comprises a thrust ball bearing 28 (FIG. 3), via which it is supported on the coupler 8 of the first four-bar linkage parallelogram 5.

Figure 2:
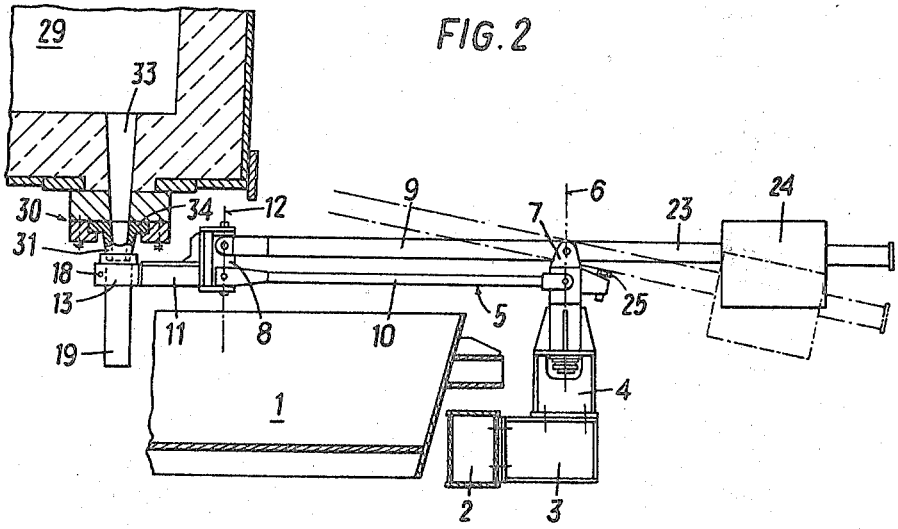
FIG. 2 is a side view along line II—II of FIG. 1.
Figures 3, 4, 5:
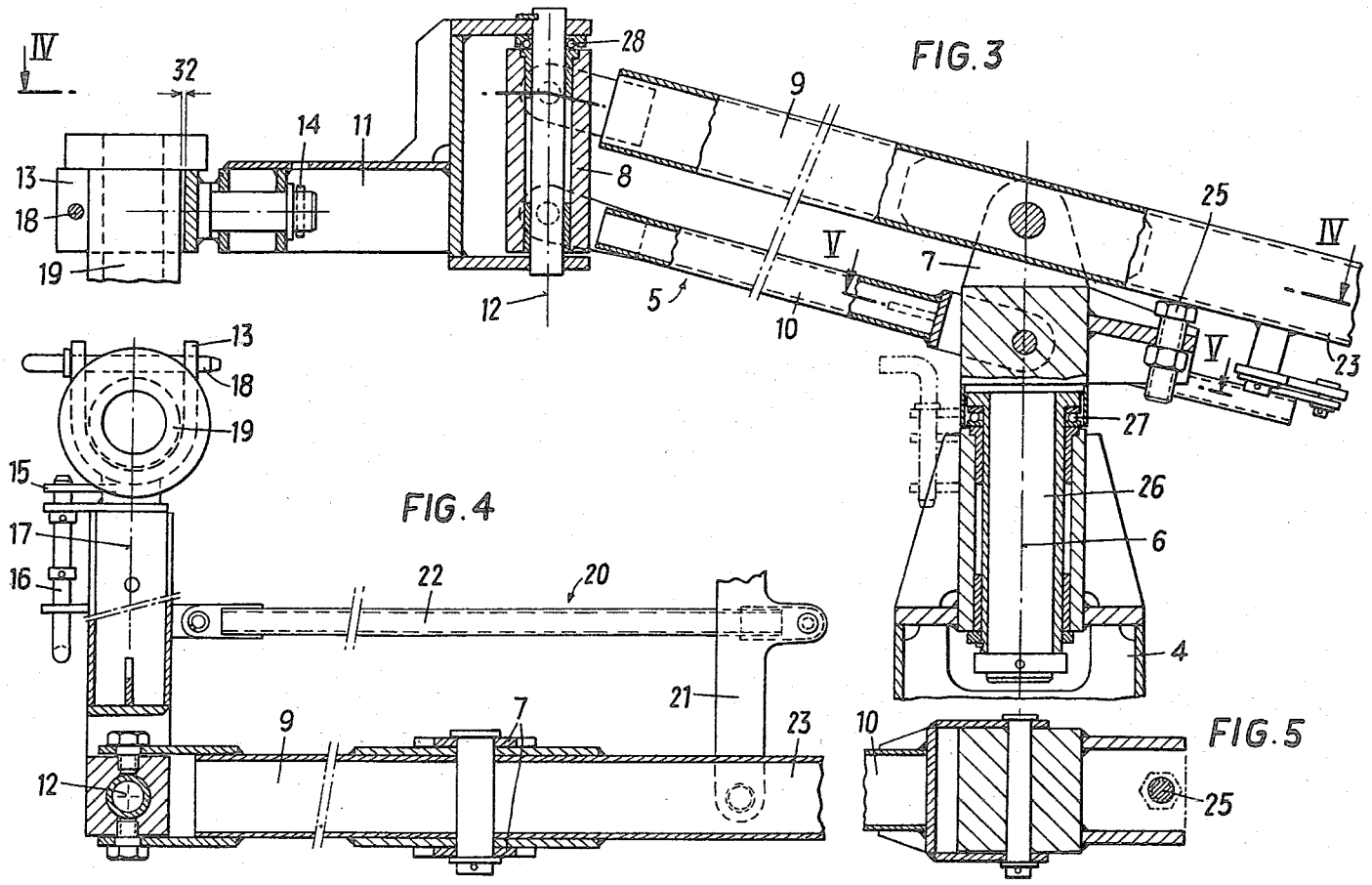
FIG. 3 is a sectional representation led along line III—III of FIG. 1.
FIG. 4 illustrates a section taken along line IV—IV of FIG. 3.
FIG. 5 is a section along line V—V of FIG. 3.

As can be seen from FIG. 2, a slide 30 is arranged on the lower side of a casting ladle 29, which slide is provided with a hollow centering shoulder 31, on which the protective tube 19 aligns. In order to enable this alignment of the protective tube on the centering shoulder 31 of the slide, the protective tube fits into the holding means with a play 32 (FIG. 3). Special sealing measures are not required. The centering shoulder is arranged on a slide plate 34 which covers the outflow opening 33 of the ladle 29 in the closing position.

Figure 9:
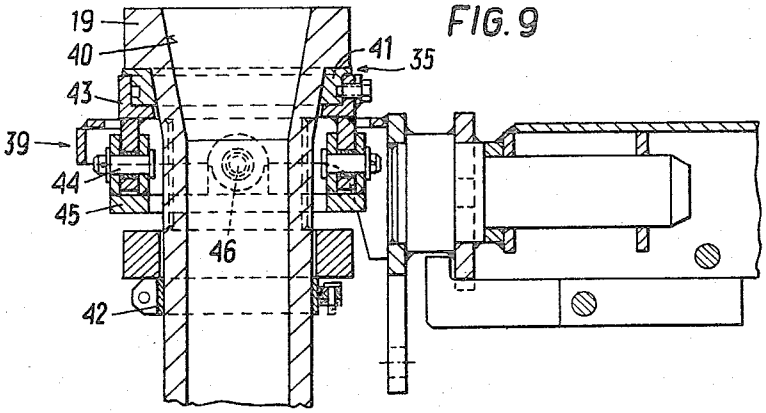
Figure 8:
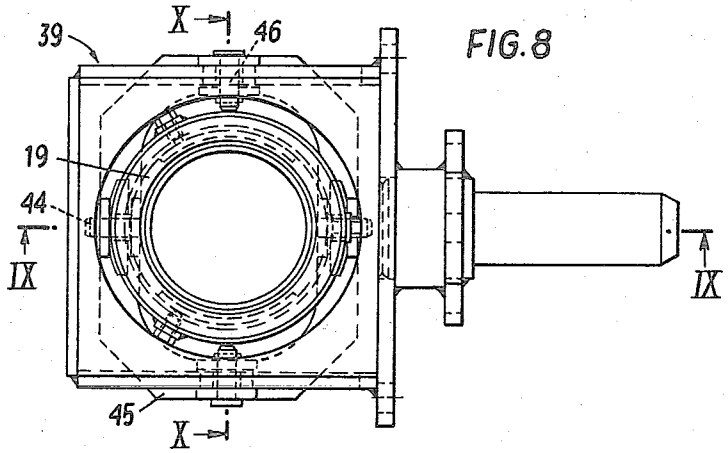
FIG. 8 shows a detail of the suspension of the protective tube according to a further variant.

According to the embodiment illustrated in FIGS. 8 and 9, the protective tube 19 is mounted in the holding means 13 by means of a bearing 35 so as to be rotatable about its longitudinal axis, thus always assuming the same position relative to the centering shoulder 31 even during a movement of the slide. A rotation of the protective tube 19 relative to the centering shoulder 31 about the axis of the outflow opening 33 of the ladle (and about the longitudinal axis of the protective tube 19) is thus out of the question.

As can be seen from FIG. 1, the protective tube 19 can be adapted to various positions of the ladle outflow-opening 33 in wide ranges. It can be pivoted both about the axis 6 of the web 7 of the first four-bar linkage parallelogram 5, according to arrows 36, and about the axis 12 of the extension arm 11 of the first four-bar linkage parallelogram 5 in the direction of the arrows 37 with the help of the second four-bar linkage parallelogram 20. For the purpose of exchanging the protective tube, the entire arrangement is pivoted about the rotation axis 6, after the protective tube has been brought out of engagement on the centering shoulder 31 by lowering.

Figure 6:
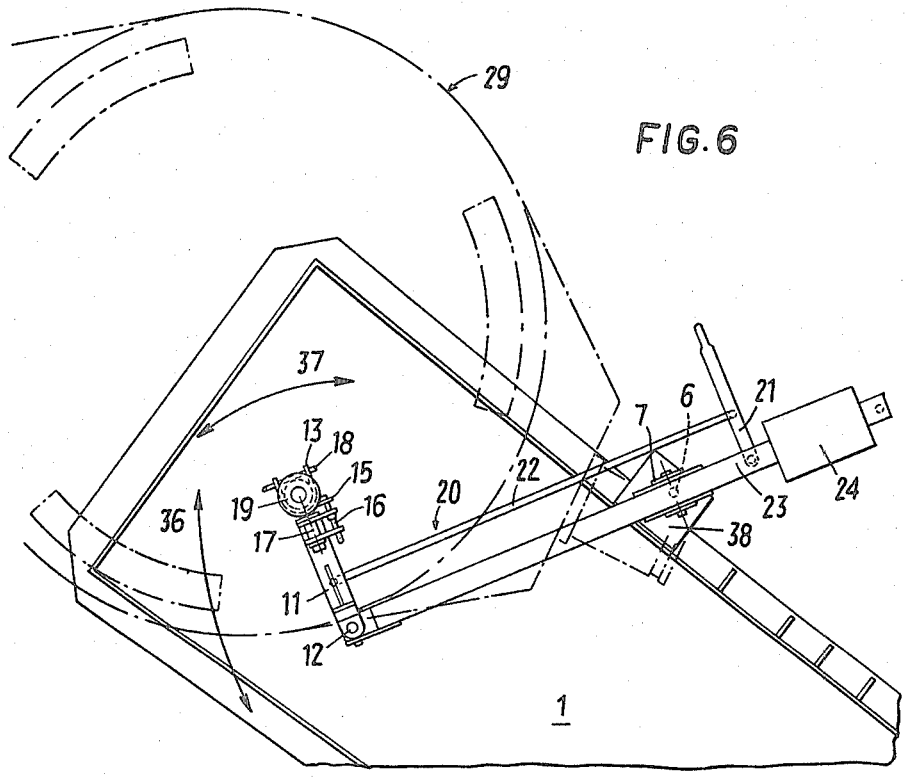
FIGS. 6 and 7 represent a further embodiment in illustrations analogous to FIGS. 1 and 2.
Figure 7:
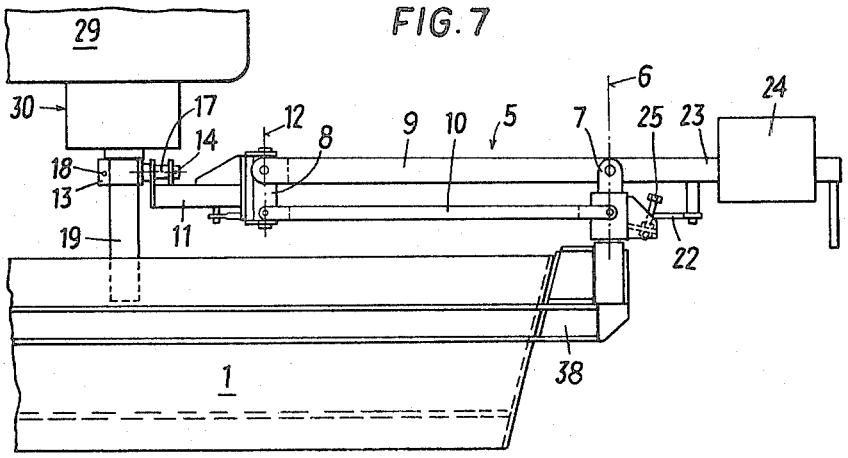

In the embodiment illustrated in FIGS. 6 and 7, the first four-bar linkage parallelogram 5 is mounted directly to the tundish 1 on a lateral console 38 of the same.

Figure 10:
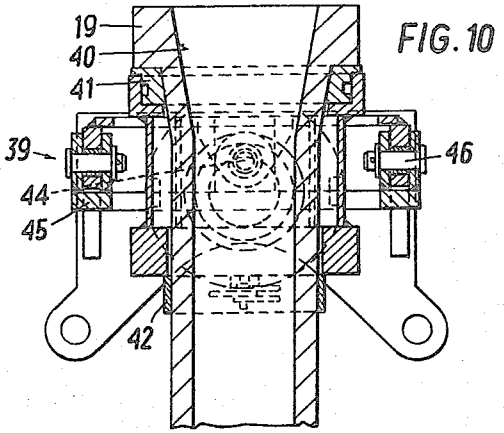
FIGS. 9 and 10 are sections along lines IX—IX and X—X, respectively, of FIG. 8.

According to the embodiment illustrated in FIGS. 8 to 10, of the protective-tube holder 39, the protective tube 19 is cardanically and rotatably mounted, whereby its position relative to the slide does not change when actuating the latter, i.e. no rotation between slide and protective tube will occur even with the slide being actuated. In addition, an exact adaptation of the conical upper part 40 of the protective tube 19 to the centering shoulder 31 of the slide can be reached by the cardanic mounting. The protective tube 19, according to this variant, is inserted in an accommodation part 41 that is rotatable relative to the protective-tube holder 39 and is secured on this accommodation part 41 against falling out by means of a loosenable collar 42. The accommodation part 41 (rotatably) rests on the first hinge plate 43, which is pivotable about an axis 44 relative to a second hinge plate 45. The second hinge plate in turn is fastened on the protective-tube holder 39 so as to be pivotable about an axis 46 that is directed at a right angle to the axis 44.

The invention is not limited to the exemplary embodiments illustrated in the drawings, but can be modified in various aspects. Thus, it is for instance possible to design the second four-bar linkage parallelogram 20 not as a four-bar linkage parallelogram, but as any desired four-bar linkage. The arrangement described may also be used for the casting tube reaching from the tundish into the mould.

What we claim is:

1. In a protection arrangement for a casting jet emerging from a metallurgical vessel, in particular a casting ladle, and of the type including an articulation-rod assembly pivotable into any space direction and a protective tube fastened to said articulation-rod assembly and enveloping said casting jet, the improvement which is characterized in that said articulation-rod assembly is formed by a first four-bar linkage of the parallelogram type, extending vertically and including first two oscillating cranks, a coupler, and a first web extending vertically, said first four-bar linkage being mounted to be rotatable about a vertical axis, an extension arm being hinged to said coupler for carrying said protective tube, and a second four-bar linkage including second two oscillating cranks, a coupler, and a second web, one of said second two oscillating cranks being formed by said extension arm and said second web being formed by one of said first two oscillating cranks.

2. An arrangement as set forth in claim 1, wherein one of said first two oscillating cranks of said first four-bar linkage of the parallelogram type has a first extension reaching beyond said first web, a counter weight being arranged on said first extension.

3. An arrangement as set forth in claim 1, wherein one of said first two oscillating cranks of said first four-bar linkage of the parallelogram-type has a first extension reaching beyond said first web, a stop being arranged on said first web, said one of said first two oscillating cranks coacting with said stop.

4. An arrangement as set forth in claim 3, wherein said stop is adjustable.

5. An arrangement as set forth in claim 1, further comprising a tundish of a continuous casting plant, and wherein said casting jet flows into said tundish and said first web of said first four-bar linkage of the parallelogram type is rotatably fastened to said tundish.

6. An arrangement as set forth in claim 1, wherein one of said second two oscillating cranks of said second four-bar linkage has a second extension, said second extension being designed as an actuation lever.

7. An arrangement as set forth in claim 2, further comprising an outflow opening provided in said casting ladle and a slide for closing said outflow opening, and wherein said slide includes a centering shoulder for supporting said protective tube, said protective tube being automatically pressable to said centering shoulder by means of said counter weight.

8. An arrangement as set forth in claim 7, wherein said protective tube is mounted on said extension arm so as to be rotatable about its longitudinal axis.

9. An arrangement as set forth in claim 7 or 8, further comprising a protective-tube holder for holding said protective tube, and a cardan joint provided between said protective tube and said protective-tube holder.

* * * * *